US009260837B1

(12) United States Patent
Wei et al.

(10) Patent No.: US 9,260,837 B1
(45) Date of Patent: Feb. 16, 2016

(54) INTELLIGENT PASS JUMP CONTROL

(71) Applicant: Caterpillar Inc., Peoria, IL (US)

(72) Inventors: Mo Wei, Dunlap, IL (US); Michael Allen Taylor, Swissvale, PA (US); Thandava Krishna Edara, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/482,857

(22) Filed: Sep. 10, 2014

(51) Int. Cl.
*E02F 3/84* (2006.01)
*E02F 3/76* (2006.01)
*E02F 9/20* (2006.01)

(52) U.S. Cl.
CPC ..... *E02F 3/841* (2013.01); *E02F 3/7609* (2013.01); *E02F 9/205* (2013.01); *E02F 9/2045* (2013.01)

(58) Field of Classification Search
USPC ..... 701/2
See application file for complete search history.

(56) References Cited

U.S. PATENT DOCUMENTS 4,918,608 A 4/1990 Middleton et al.
5,935,192 A 8/1999 Henderson et al.
6,076,030 A * 6/2000 Rowe ..... E02F 3/435 172/4.5
6,167,336 A * 12/2000 Singh ..... E02F 3/434 172/2
6,363,632 B1 * 4/2002 Stentz ..... E02F 3/437 37/348
6,385,494 B1 * 5/2002 Blahnik ..... G06F 8/60 700/18
6,845,311 B1 1/2005 Stratton et al.
7,747,369 B2 6/2010 Koehrsen et al.
8,345,926 B2 1/2013 Clark et al.
8,620,533 B2 * 12/2013 Taylor ..... E02F 3/437 37/348
8,639,393 B2 * 1/2014 Taylor ..... E02F 9/2045 701/2
8,948,981 B2 * 2/2015 Wei ..... E02F 3/841 172/4.5
2004/0073468 A1 * 4/2004 Vyas ..... G06Q 10/0631 705/7.13
2012/0136508 A1 * 5/2012 Taylor ..... E02F 9/2045 701/2
2014/0180548 A1 6/2014 Thandava et al.
2014/0346854 A1 * 11/2014 Horton ..... B60T 13/686 303/13

* cited by examiner

*Primary Examiner* — Thomas Tarcza
*Assistant Examiner* — Alex C Dunn
(74) *Attorney, Agent, or Firm* — Miller, Matthias & Hull LLP

(57) ABSTRACT

A system for controlling an earthmoving machine is provided. The system includes a positioning system and a controller. The controller is configured to receive the position signals from the positioning system, store the position signals in a pass history, and determine, based on pass history, an actual profile of the work surface. The controller is further configured to determine, based on the actual profile of the work surface in the pass history, existence of a first condition, the first condition exists when the actual profile has a first volume having a height above a threshold for an upper pass, and existence of a second condition, the second condition exists when the actual profile has a valley having a floor lower than the threshold for the upper pass. The controller is configured to direct the earthmoving machine to operate based on the lower pass if the first and second conditions exist.

20 Claims, 5 Drawing Sheets

INTELLIGENT PASS JUMP CONTROL

TECHNICAL FIELD OF THE DISCLOSURE

The present disclosure generally relates to controlling an earthmoving machine and, more particularly, relates to systems and methods for intelligently controlling pass jump for an earthmoving machine.

BACKGROUND OF THE DISCLOSURE

Earthmoving machines, such as bulldozers, may be used to move materials at a work site. Such machines may operate in an autonomous or semi-autonomous manner to perform ground moving tasks in response to commands generated as part of a work plan for the machine. The machine may receive instructions based on such a work plan to perform operations (e.g., cutting, digging, loosening, carrying, etc.) at the worksite.

If such a machine operates autonomously, it may remain consistently productive without needing manual operation. Autonomous control systems may also allow for operation in work sites or environments which may be unsuitable or undesirable for a human operator. Further, autonomous and semi-autonomous systems may also compensate for inexperienced human operators and inefficiencies associated with repetitive ground moving tasks.

Control of ground moving machines and their associated work tools or implements is often developed by an on-board or off-board control system. Conditions associated with work sites, operation environment, and/or the machine itself may affect operation of the control system. Also, such conditions may have an effect on the overall efficiency of the machine or its associated work cycle. It is beneficial to determine such conditions and manage the control of earthmoving machines to ensure that material moving operations are performed in an efficient manner. Similarly, the locations at which earthmoving machines alter surfaces of a work site, and/or the profiles along which the machines alter the surfaces, should be chosen such that the machine functions efficiently.

Rework is one problem which may arise and impair efficiency during earthmoving processes wherein multiple passes are made by the earthmoving machine. Rework entails a need to remove materials from an area of a work site in which materials have already been removed. In some situations, such as automatic slot extension and terrain extensions, a volume may be created downstream of the initial spread location, the volume being above a planned first pass. The volume above the first planned pass may create a valley upstream of the volume which is below the threshold of the first pass. In operation, the earthmoving machine may revert to the first planned pass due to this volume. For example, a control system may determine that the system must "jump" the pass back to the path of the first pass for a "compensated" cut prior to making a second pass. Because, during this "compensated" cut, the work implement cannot go below the carry surface of the first pass, dozed material may fall into the valley, instead of being directly dumped into a spread location. In these scenarios, rework may be required during the earthmoving operation. Rework may lead to inefficiencies or low productivity.

SUMMARY OF THE DISCLOSURE

In accordance with one aspect of the present disclosure, a system is disclosed for controlling an earthmoving machine and a work implement associated with the earthmoving machine during an earthmoving operation on a work surface. The earthmoving operation may include an upper pass and a lower pass. The system may include a controller and a positioning system associated with the machine for generating position signals indicative of a position of the work surface. The controller may be configured to execute instructions to receive the position signals from the positioning system, store the position signals in a pass history, and determine, based on pass history, an actual profile of the work surface.

The controller may be further configured to determine, based on the actual profile of the work surface in the pass history, the existence of a first condition, the first condition existing when the actual profile has a volume having a height above a threshold for the upper pass. The controller may be further configured to determine, based on the actual profile of the work surface in the pass history, the existence of a second condition, the second condition existing when the actual profile has a valley having a floor lower than the threshold for the upper pass. The controller may be further configured to direct the earthmoving machine to operate based on the lower pass if the first and second conditions exist. In other example systems, the act of directing the earthmoving machine to operate on the lower pass may include setting a cut location based on the lower pass.

In accordance with another aspect of the disclosure, a method is disclosed for controlling an earthmoving machine and a work implement associated with the earthmoving machine during an earthmoving operation on a work surface. The earthmoving operation may include an upper pass and a lower pass. The method may include receiving position signals from a positioning system associated with the machine, the position signals indicative of a position of the work surface, storing the position signals in a pass history, and determining, based on the pass history, an actual profile of the work surface.

The method may further include determining, based on the actual profile of the work surface in the pass history, the existence of a first condition, the first condition existing if the actual profile has a first volume having a height above a threshold for the upper pass. The method may further include determining, based on the actual profile of the work surface in the pass history, the existence of a second condition, the second condition exists when the actual profile has a valley having a floor lower than the threshold for the upper pass. The method may further include directing the earthmoving machine to operate based on the lower pass if the first and second conditions exist. In some further example methods, the method may include setting a cut location based on the lower pass if the first and second conditions are present.

In accordance with yet another aspect of the disclosure, an earthmoving machine is disclosed. The earthmoving machine may include a prime mover, a work implement for cutting a work surface during an earthmoving operation (e.g., including at least an upper pass and a lower pass), a positioning system associated with the machine for generating position signals indicative of a position of the work surface and a controller. The controller may be further configured to determine, based on the actual profile of the work surface in the pass history, existence of a first condition, the first condition existing when the actual profile includes a first volume having a height above a threshold for the upper pass.

The controller may be further configured to determine, based on the actual profile of the work surface in the pass history, the presence of a second condition, the second condition existing when the actual profile includes a valley having a floor lower than the threshold for the upper pass. The controller may be further configured to direct the earthmoving machine to operate based on the lower pass if the first and second conditions exist. In some examples, directing the earthmoving machine to operate on the lower pass includes setting a cut location for the work implement based on the lower pass.

Other features and advantages of the disclosed systems and principles will become apparent from reading the following detailed disclosure in conjunction with the included drawing figures.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION OF THE DISCLOSURE

The present application discloses systems and methods for controlling an earthmoving machine using a control system. More specifically, the systems and methods may increase efficiency, for example, by optimizing cut locations on a work surface to avoid rework by controlling pass jump of the machine and selecting optimal cut locations.

Figure 1:
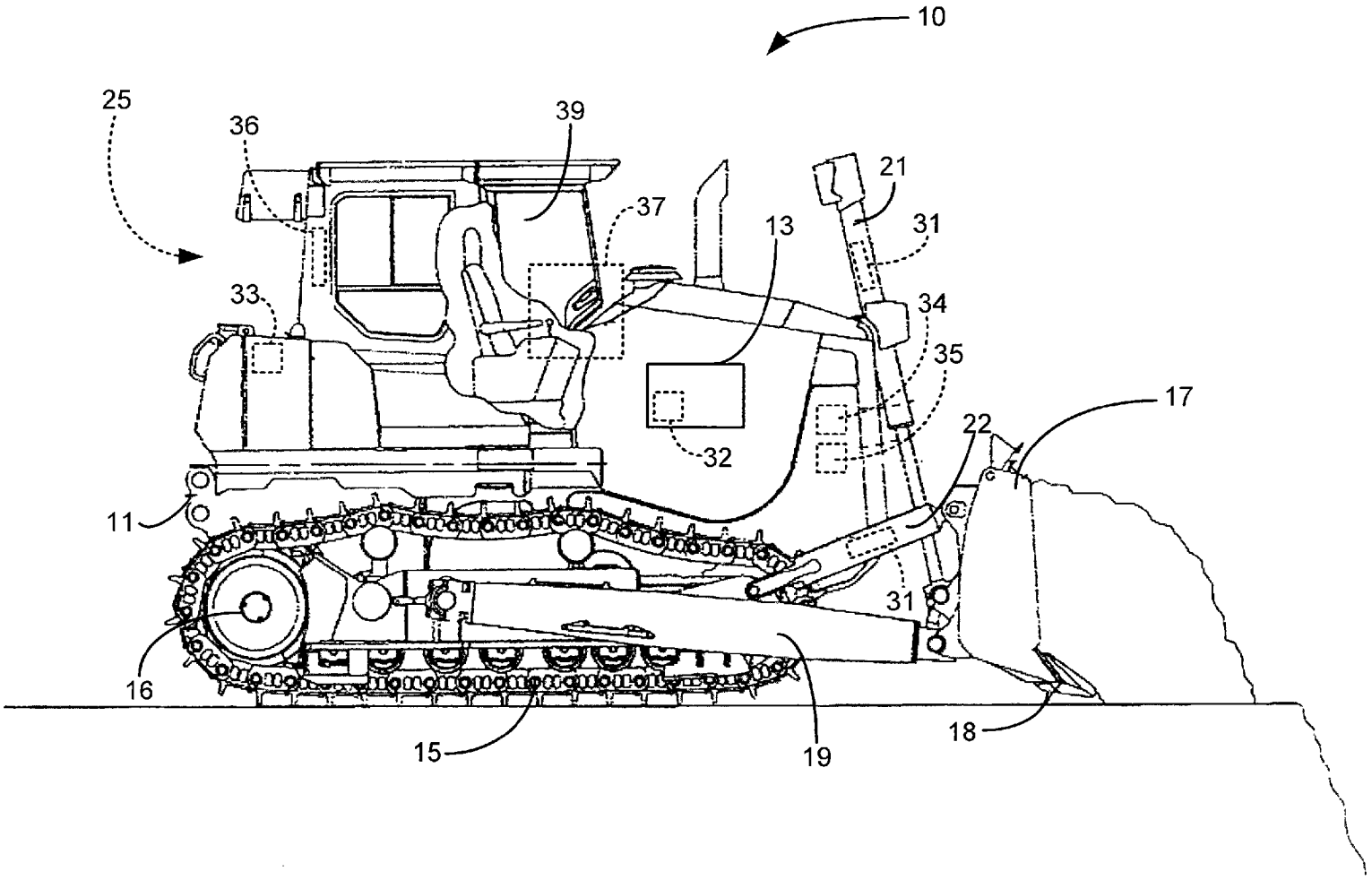
FIG. 1 is a side view of a machine having a control system in accordance with the present disclosure.

Turning now to the drawings and with specific reference to FIG. 1, an earth moving machine 10 is shown. In the illustrated embodiment, the machine 10 is shown as a bulldozer; however, the machine 10 is not limited to being a bulldozer, but may be any earth moving machine that is configured to move materials on a worksite. Worksites on which the machine 10 may move material include, but are not limited to including, a mining site, a landfill, a quarry, a construction site, or any other area in which movement of material is desired. The machine 10, and its respective elements detailed below, may be employed at a worksite for a variety of earth moving operations, such as dozing, grading, leveling, bulk material removal, or any other type of operation that results in alteration of topography of the worksite.

Generally, the machine 10 includes a frame 11 and a prime mover, such as an engine 13. A track 15 is included as a ground-engaging drive mechanism and the track 15 is driven by a drive wheel 16 on each side of the machine 10 to propel the machine 10. While the machine 10 is shown having the track 15 and is, generally, a "track-type" machine, other ground-engaging mechanisms are certainly possible (e.g., tires in a wheeled configuration).

For earthmoving, the machine 10 may employ a work implement, such as the blade 17, to push or otherwise move materials at a worksite. During earth moving functions, the blade 17 may initially engage the worksite with a blade tip 18 of the blade 17. The blade 17 may be pivotally connected to the frame 11 by arms 19 on each side of the machine 10. One or more first hydraulic cylinders 21 may be coupled to the frame 11 to support the blade 17 in the vertical direction and allow the blade 17 to move up or down vertically. Additionally, one or more second hydraulic cylinders 22 may be included on each side of the machine 10 to allow the pitch angle of the blade tip 18 to change relative to a centerline 23 of the machine 10.

Figure 2:
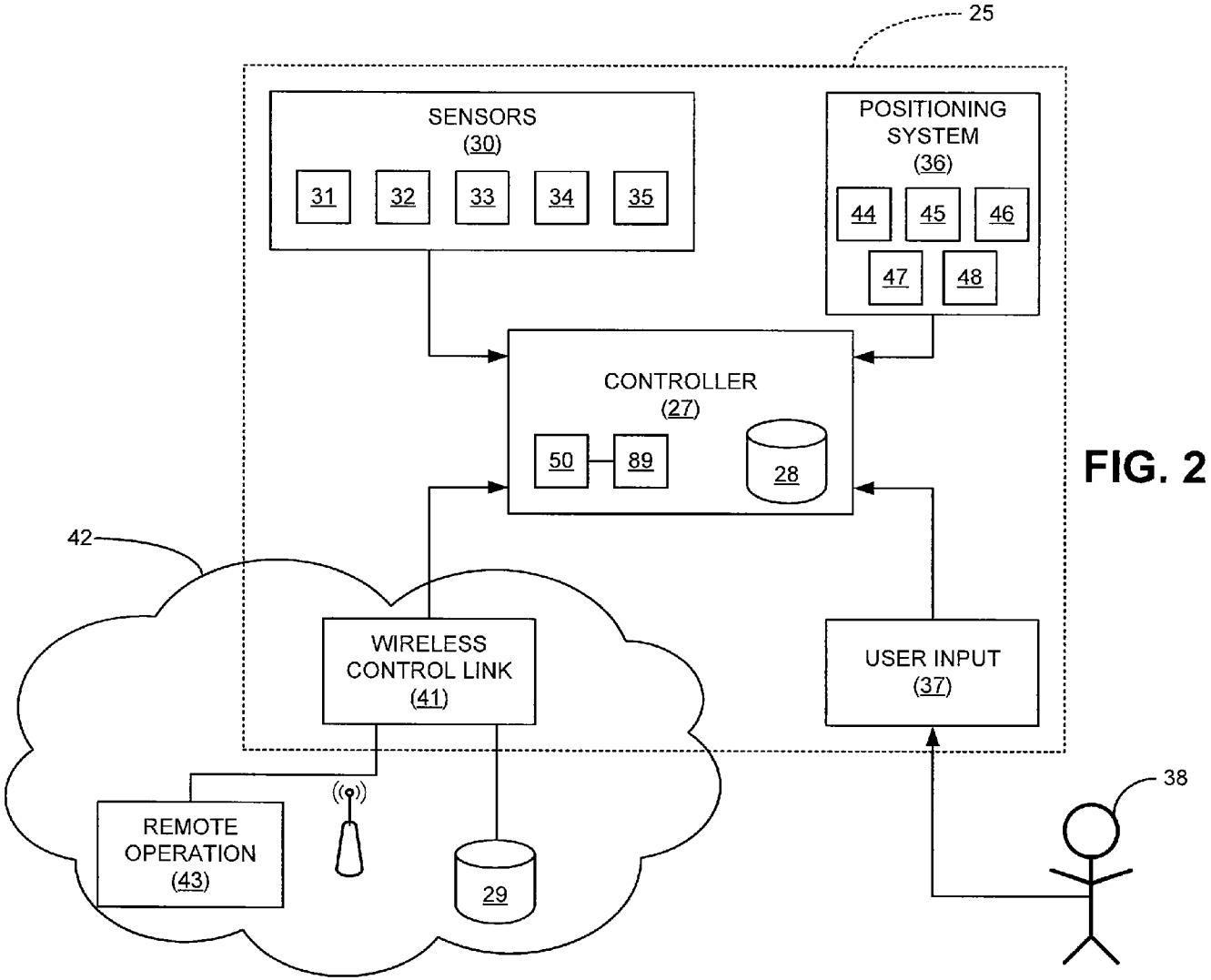
FIG. 2 is a schematic diagram of the control system of FIG. 1 in accordance with the present disclosure.

Turning now to FIG. 2 and with continued reference to FIG. 1, a schematic diagram of a control system 25 for controlling operations of the machine 10 is shown. While the connections between elements of the control system 25 are best shown in the schematic view of FIG. 2, some elements are also represented in FIG. 1 and denoted, schematically, by boxes having dotted lines. The control system 25 may be used to control the machine 10 in a variety of autonomous, semi-autonomous, or manual modes. As used herein, a machine 10 operating in an autonomous manner operates automatically based upon information received from various sensors without the need for human operator input. Further, a machine 10 operating semi-autonomously includes an operator, either within the machine 10 or remotely, who performs some tasks or provides some input while other tasks are performed automatically based upon information received from various sensors. A machine 10 being operated manually is one in which an operator is controlling all or essentially all of the direction, speed and manipulating functions of the machine 10. A machine may be operated remotely by an operator (e.g., remote control) in either a manual or semi-autonomous manner.

Operation of the machine 10, in any of the above referenced manners, may be executed by a controller 27. The controller 27 may be any electronic controller or computing system including a processor which operates to perform operations, execute control algorithms, store data, retrieve data, gather data, and/or any other computing or controlling task desired. The controller 27 may be a single controller or may include more than one controller disposed to control various functions and/or features of the machine 10. Functionality of the controller 27 may be implemented in hardware and/or software and may rely on one or more data maps relating to the operation of the machine 10. To that end, the controller 27 may include internal memory 28 and/or the controller 27 may be otherwise connected to external memory 29, such as a database or server. The internal memory 28 and/or external memory 29 may include, but are not limited to including, one or more of read only memory (ROM), random access memory (RAM), a portable memory, and the like. Such memory media are examples of nontransitory memory media.

For determining characteristics associated with the machine 10, the controller 27 may be operatively associated with one or more machine sensors 30. The term "sensor" is used in its broadest sense to include one or more sensors and related components that may be associated with the machine 10 and that may operate to sense a function, operation, and/or operating characteristics of the machine. The machine sensors may provide data, either directly or indirectly, which is indicative of various parameters and conditions associated with the machine 10. As shown, the machine sensors 30 include hydraulic pressure sensors 31, engine speed sensor 32, an accelerometer 33, a pitch angle sensor 34, and a pitch rate sensor 35. However, the machine sensors 10 are not limited to including the referenced sensors and may include any other sensors useful for providing information associated with conditions of the machine 10 to the controller 27.

In the example control system 25, hydraulic pressure sensors 31 are shown which may be associated with one or more of the first hydraulic cylinders 21 and/or the second hydraulic cylinders 22. The hydraulic pressure information obtained by the hydraulic pressure sensors 31 may be useful in determining and/or controlling positions of the blade 17. Further, the engine speed sensor 32 may be used to determine conditions associated with the engine 13. The accelerometer 33 is useful for determining acceleration of the machine 10 along various axes of operation. The pitch angle sensor 34 and pitch rate sensor 35 are useful for determining any roll, pitch, or yaw of the machine 10.

The control system 25 may also include a positioning system 36 for monitoring and/or controlling movement of the machine 10, which may include, for example a global positioning system ("GPS"). The positioning system 36 may sense the position of the machine 10 relative to an associated work area. The positioning system 36 may include a plurality of individual sensors that cooperate to provide signals to the controller 27 to indicate the position of the machine 10. Using the positioning system 36, the controller may determine the position of the machine 10 within the work area as well as the orientation of the machine, such as its heading, pitch, and roll. With said information, dimensions of the machine 10 may be stored by the control system 25 with the positioning system 36 defining a datum or reference point on the machine and the controller using the dimensions to determine the position of the terrain or work surface upon which the machine is moving.

User input 37 may be included with the control system 25 so that an operator 38 may have the ability to operate the machine. For example, user input 37 may be provided in a cab 39 of the machine 10, wherein the operator 38 may provide commands when the machine 10 is operating in either a manual or semi-autonomous manner. The user input 37 may include one or more input devices through which the operator 38 may issue commands to control the propulsion and steering of the machine 10 as well as operate various implements associated with the machine 10.

Additionally or alternatively, the control system 25 may include a wireless control link 41 which is connected to a wireless network 42. Via the wireless control link 41, commands may be given to the machine 10 via the controller 27 from a remote operation 43 (e.g., a command center, a foreman's station, and the like). Further, information may be accessed from and/or stored to the remote memory 29. In certain embodiments, control of the machine 10 via the control system 25 may be distributed such that certain functions are performed at the machine 10 and other functions are performed via remote operation 43.

As mentioned above, the positioning system 36 may be employed to determine an actual profile of a work surface to be used in a work plan. The positioning system may include one or more GPS sensors 44 for detecting locations of the machine 10 or one or more elements of the machine 10 relative to the worksite. Other elements of the positioning system 36 may include, but are not limited to including, odometers 45, wheel rotation sensing sensors 46, perception based system sensors 47, and laser position detection systems 48. All elements of the positioning system may be used to determine the real time actual profile of the work surface to be used for analysis by the control system 25. Of course, other elements aiding in detecting positioning of the machine 10 or the worksite may be included and input from the system sensors 30 may also be used in determining the actual profile of the work surface.

Further, the control system 25 may be configured to implement a material movement plan 50. The material movement plan may be instructions stored on at least one of the internal memory 28 and/or the external memory 29 and executed by the controller 27. The material movement plan 50 may be influenced by elements of the control system 25, such as input from any of the sensors 30, the positioning system 36, the user input 37, the remote operation 43, or any other conditions or controls associated with the machine 10. The material movement plan may include one or more passes for a ground moving operation and may provide plans for cut locations based on the one or more passes.

Figure 3:
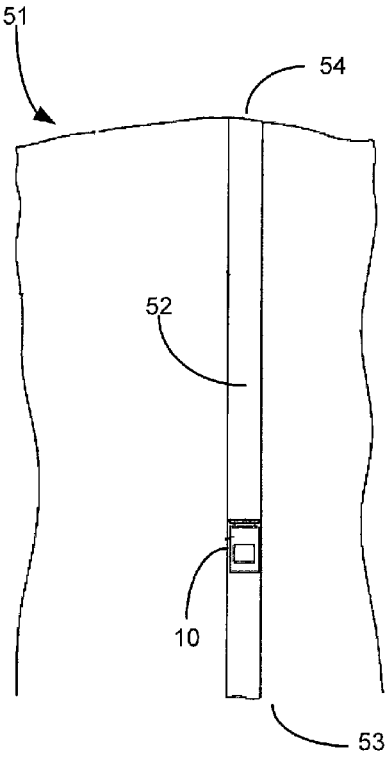
FIG. 3 is an overhead view of an example worksite on which an earthmoving operation may be performed by the machine of FIG. 1.

As shown, generally, in FIG. 3, the machine 10 may operate at a worksite 51 to move material to create a slot 52. The slot may begin at an initial location 53 and end at a spread location 54. The machine 10 may be configured to move material at the work site 51 according to the material movement plan 50. The material movement plan 50 may provide specific instructions for specific cuts involved in moving material to the spread location 54.

Figure 4:
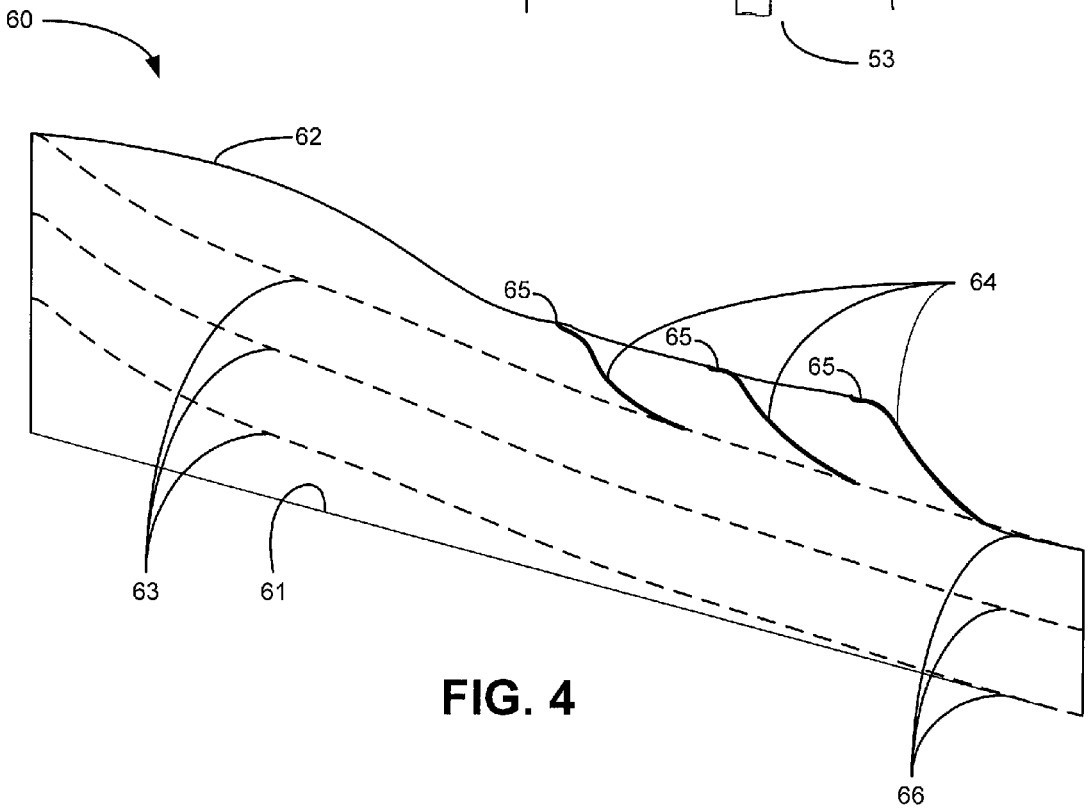
FIG. 4 is a cross section of an example work surface at a work site depicting various aspects of a material moving plan.

For purposes of explanation, FIG. 4 shows a cross section of an example slot work plan 60 for forming a slot in a work surface. The slot 60 may be formed by initially setting the desired parameters of the final work surface or final design plane 61. Material may be removed from a top work surface 62 in one or more passes 63 until the final design plane 61 is reached. The blade 17 of the machine 10 may engage the work surface 62 with a series of cuts 64 that are spaced out lengthwise along the slot 60. Each cut 64 begins at a cut location 65 along the work surface 60, at which the blade 17 initially engages the work surface and extends into the moved material toward a spread location 66 for each particular pass. The control system 25 may be configured to guide the blade 17 along each cut 64 until reaching the spread location 66 then follow the spread location 66 towards a downstream dump location.

Figure 5:
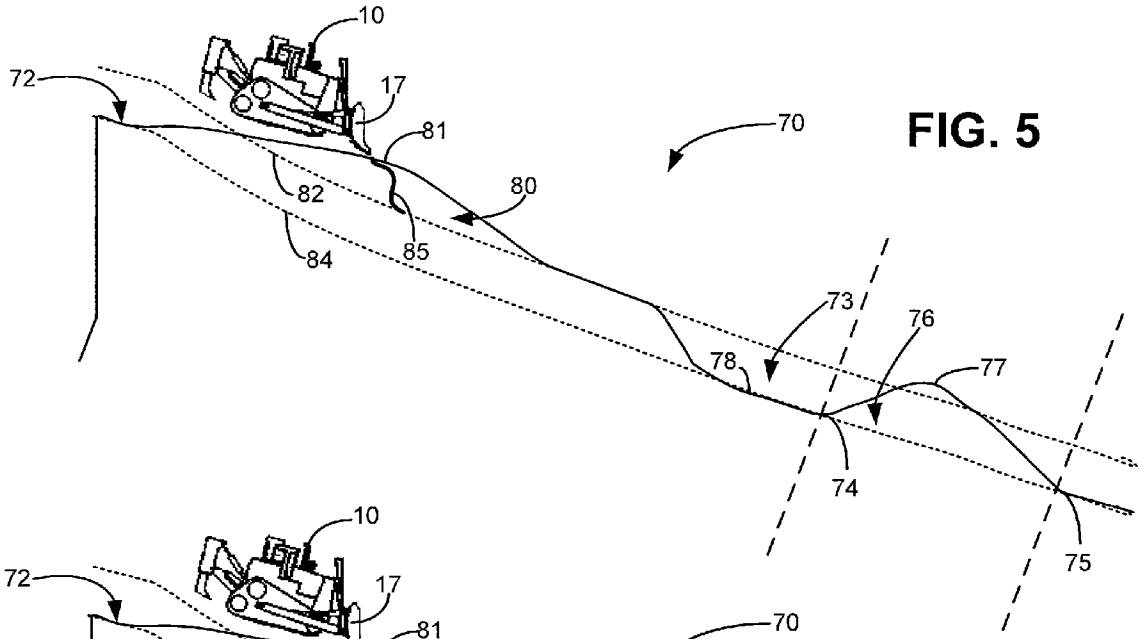
FIG. 5 is a cross section of an example work surface at a work site depicting various aspects of a material moving plan for a slot-extended work site in accordance with the present disclosure.

Turning now to FIG. 5, an example work plan 70, such as an earthmoving operation for a work surface 72, is shown. The work surface 72 is shown having a valley 73 defined in the work surface 72. The valley 72 may have been formed during slot extension process wherein the spread location of the work plan 70 was moved from the original spread location 74 to an extended spread location 75. Thusly, the work surface 72 on which the work plan 70 is designed to cut now includes a downstream volume 76 having a height 77 which is greater than a floor 78 of the valley 73 and also greater than a threshold of an upper pass 82 at that point on the work surface 72.

The work surface 72 further includes the first volume 80, having a height 81. The height 81 is greater than the height of the upper planned pass 82 of the work plan 70. The floor 78 of the valley 73 is below the threshold height defined by the upper pass 82 but at or above a defined height of a lower pass 84. During some automated earthmoving operations, machines on a path will not lower their blades below the threshold of a pass, such as, for example, the threshold defined by pass 82. Therefore, if the machine 10 were operating in such an autonomous manner and the blade 17 makes a cut 85, the materials moved during that cut 85 will move along the path and fall into the valley 73 because the blade 17 will not be lowered below the threshold of the first pass 82. Because the materials are not taken to the spread location 75, this may cause the machine to need to rework the area at the valley 73 because it may create a new volume above the initial floor 78 of the valley 73.

Figure 6:
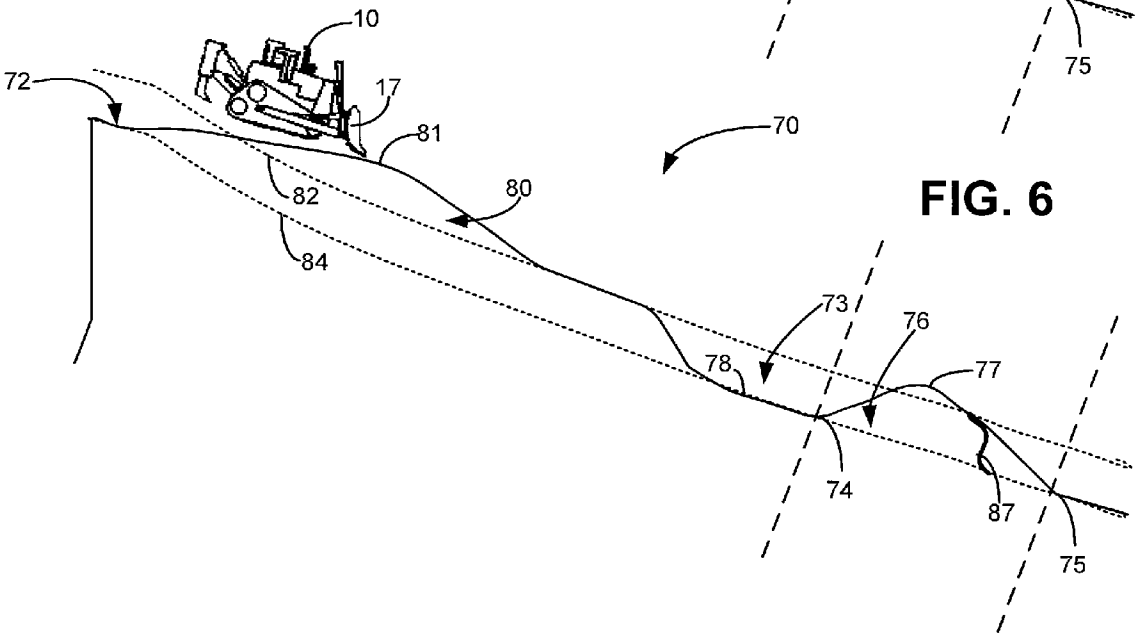
FIG. 6 is the cross section of the example work surface at a work site depicting various aspects of a material moving plan for a slot-extended work site of FIG. 5 and having an alternative cut location.

Alternatively, in FIG. 6, the work plan 70 is shown having a cut 87 at the downstream volume 76. The cut 87 will take the materials to the spread location 75 without creating an unintentional volume at the valley 73, which would require rework, like the cut 85 in FIG. 5. The material movement plan 50 may be used to avoid rework by controlling the machine 10 to avoid improper pass jump and optimize cut locations.

For example, the machine 10 may be operating autonomously to execute the material movement plan 50 which includes, at least, the upper pass 82 and the lower pass 84. Using position signals received from the positioning system 36, the control system 25 can determine the actual terrain of the work surface 72. If, in evaluating the terrain of the work surface 70, the system 25 determines that the work surface includes a volume above the first pass (e.g., the volume 76 having a height 77) downstream of a lower work surface (e.g., the valley 73, having a floor 78), the system will not jump the pass back to the upper pass 82. Rather, the system 25 will intelligently control the passes based on a pass history 89 (shown in FIG. 2 in association with the material movement plan 50) of the terrain of the work surface 72, in its entirety, to avoid rework. The pass history 89 may be continuously updated to provide an accurate model of the terrain of the work surface 72. The pass history 89 may be, for example, a computer model of the work surface 72 detailing prior and future passes to be made in the work surface 72 during earthmoving operations. In certain conditions, detailed more specifically below, the system 25 may reset the pass history.

Figure 7:
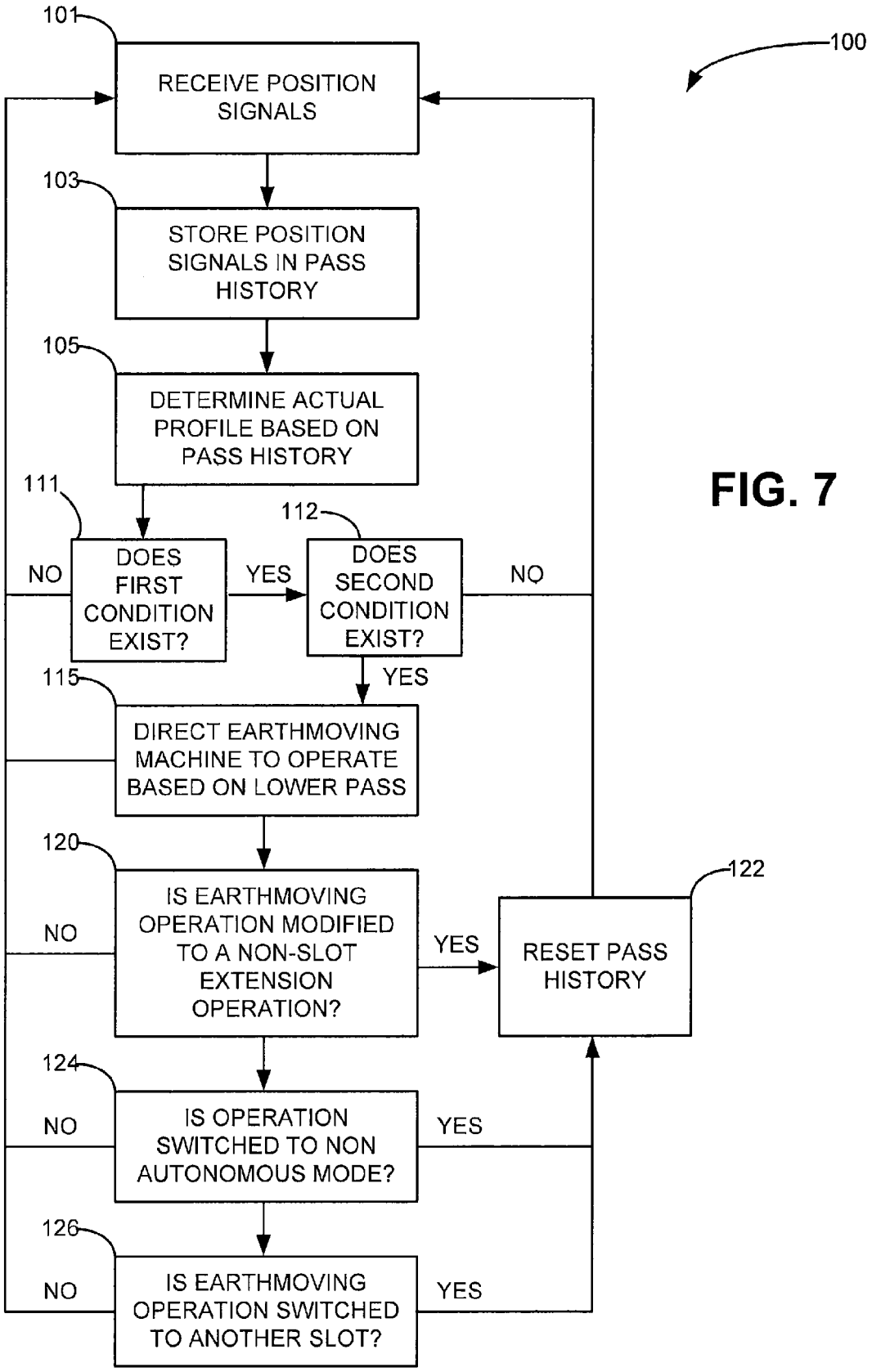
FIG. 7 is a flowchart illustrating a method for controlling an earthmoving machine during an earthmoving process in accordance with the present disclosure.

To control the planning of cuts based on passes during formation of a slot, the control system 25 may implement the method 100 of FIG. 7, which may be implemented as part of, for example, the material movement plan 50. The method 100 may be instructions stored on at least one of the internal memory and/or the external memory 29 and executed by the controller 27. Further, the method 100 may be implemented remotely by the remote operation 43 in conjunction with the wireless control link 41 and controller 27. The planning method 100 is not limited to being executed by the above mentioned elements of the control system 25 and may be implemented using any combination of autonomous, semi-autonomous, and/or manual controls.

The method 100 begins when the controller 27 receives position signals from the positioning system 36 (block 101). Using the received positioning signals, the controller 27 may determine store the position signals in the pass history 89 (block 103). The actual profile and its relationship to the current pass on which the machine 10 is operating (e.g., the upper pass 82 or the lower pass 84) will be stored as a pass history in, for example, at least one of the internal memory 28 or the external memory 29. Based on the information stored in the pass history 89, the method 100 may then determine an actual model profile of the work surface 72 (block 105).

Based on the actual profile of the work surface 72, the method 100 may determine if a first condition exists, the first condition being that a first volume of the work surface 72 includes a height above a threshold for the upper pass 82 (e.g., the first volume 80 having the first height 81 of FIGS. 5 and 6) (block 111). The method 100 may also determine if a second condition exists, with respect to the work surface 72, the second condition being that the work surface 72 includes a valley having a floor lower than the threshold for the upper pass 82 (e.g., the valley 73 having the floor 78 of FIGS. 5 and 6) (block 112). If both conditions are present, the machine 10 may be directed to operate based on the lower pass 84 (block 115). Directing the machine 10 to operate based on the lower pass 84 may include, but is not limited to including, setting a cut location based on the lower pass if the first and second condition are present (e.g., the cut location 87).

In some example embodiments, the earthmoving operation being performed by the machine 10 may include a slot extension operation. In such example embodiments, the method 100 may further include determining if the earthmoving machine switches to another operation other than an earthmoving operation (block 120) and resetting the pass history 89 if the earthmoving operation switches to another operation (block 122).

As mentioned above, the machine 10 may be configured to perform earthmoving operations in an autonomous mode. If the machine 10 is initially operating in an autonomous mode and switches to a non-autonomous mode (e.g., a manual or semi-autonomous mode) (block 124) then the pass history 89 may be reset (block 122). Further, if the earthmoving operation is switched from one slot to another (block 126) the pass history 89 may be reset as well (block 122).

INDUSTRIAL APPLICABILITY

The present disclosure relates generally to control systems for earthmoving machines and, more specifically, to control systems for intelligent pass jump control and optimization of cut location. The foregoing is applicable to earthmoving machines, such as the machine 10, operating at worksites that include, but are not limited to including, a mining site, a landfill, a quarry, a construction site, or any other area in which movement of material is desired. The disclosed systems and methods may be useful in avoiding rework at the worksite by optimizing cut locations on the worksite based on the sensed topography which shows the current progress of the earthmoving operation. The systems and methods disclosed above may be especially useful in slot creation operations and slot-extension operations wherein the spread location is moved to a downstream location of the worksite.

The manner of operation of the systems and methods and various parameters thereof may be set by an operator, management of the worksite, or other personnel as desired. Such operation may be employed by a controller and received remotely or on-board the machine.

It will be appreciated that the present disclosure provides a systems and methods for controlling an earthmoving machine and an earthmoving machine. While only certain embodiments have been set forth, alternatives and modifications will be apparent from the above description to those skilled in the art. These and other alternatives are considered equivalents and within the spirit and scope of this disclosure and the appended claims.

What is claimed is:

1. A system for controlling an earthmoving machine and a work implement associated with the earthmoving machine during an earthmoving operation on a work surface, the earthmoving operation including an upper pass and a lower pass, the system comprising:

a positioning system associated with the earthmoving machine, the positioning system generating position signals indicative of a position of the work surface; and a controller configured to execute instructions to:

receive the position signals from the positioning system;

store position signals in a pass history;

determine, based on the pass history, an actual profile of the work surface;

determine, based on the actual profile of the work surface in the pass history, existence of a first condition, the first exists when the actual profile of the work surface includes a first volume having a height above a threshold for the upper pass;

determine, based on the actual profile of the work surface in the pass history, existence of a second condition, the second condition exists when the actual profile of the work surface includes a valley having a floor lower than the threshold for the upper pass; and direct the earthmoving machine to operate based on the lower pass if the first and second conditions exist.

2. The system of claim 1, wherein directing the earthmoving machine to operate on the lower pass includes setting a cut location based on the lower pass.

3. The system of claim 1, wherein the controller is configured to receive instructions from a remote operation.

4. The system of claim 3, further comprising a wireless control link associated with the controller, the wireless control link receiving the instructions from the remote operation.

5. The system of claim 1, wherein the controller is operating in an autonomous mode.

6. The system of claim 1, further comprising user input associated with the controller, the user input for providing instructions to the controller in a semi-autonomous or manual mode.

7. The system of claim 6, wherein the controller is operating in an autonomous mode and the controller is further configured to execute instructions to reset the pass history if the controller is reconfigured to operate in a semi-autonomous mode or a manual mode.

8. The system of claim 1, wherein the positioning system includes, at least, a global positioning system (GPS).

9. The system of claim 1, wherein the positioning system includes, at least one of an odometer, a wheel rotation sensor, a perception based sensing system, and laser position detection systems.

10. A method for control of an earthmoving machine and a work implement associated with the earthmoving machine during an earthmoving operation on a work surface, the earthmoving operation including an upper pass and a lower pass, the method comprising:

receiving position signals from a positioning system associated with the earthmoving machine, the position signals indicative of a position of the work surface;

storing the positioning signals in a pass history;

determining, based on the pass history, an actual profile of the work surface;

determining, based on the actual profile of the work surface in the pass history, existence of a first condition, the first exists when the actual profile of the work surface includes a first volume having a height above a threshold for the upper pass;

determining, based on the actual profile of the work surface in the pass history, existence of a second condition, the second condition exists when the actual profile of the work surface includes a valley having a floor lower than the threshold for the upper pass; and directing the earthmoving machine to operate based on the lower pass if the first and second conditions exist.

11. The method of claim 10, further comprising setting a cut location based on the lower pass if the first and second conditions are present.

12. The method of claim 10, wherein the earthmoving operation is a slot extension operation.

13. The method of claim 12, further comprising resetting the pass history if earthmoving operation is modified to an operation other than a slot extension.

14. The method of claim 10, wherein the earthmoving machine is operating in an autonomous mode.

15. The method of claim 14, further comprising resetting the pass history if operation of the earthmoving machine is switched to operation in a non-autonomous mode.

16. The method of claim 10, wherein the earthmoving operation includes plans for creating a first slot and a second slot and the upper pass and lower pass are associated with the first slot.

17. The method of claim 16, further comprising resetting the pass history if the earthmoving operation switches from the first slot to the second slot.

18. An earthmoving machine comprising:

a prime mover;

a work implement for cutting a work surface during an earthmoving operation, the earthmoving operation including at least an upper pass and a lower pass;

a positioning system for generating position signals indicative of a position of the work surface; and a controller configured to execute instructions to:

receive the position signals from the positioning system;

store position signals in a pass history;

determine, based on the pass history, an actual profile of the work surface;

determine, based on the actual profile of the work surface in the pass history, existence of a first condition, the first condition exists when the actual profile of the work surface includes a first volume having a height above a threshold for the upper pass;

determine, based on the actual profile of the work surface in the pass history, existence of a second condition, the second condition exists when the actual profile of the work surface includes a valley having a floor lower than the threshold for the upper pass; and direct the earthmoving machine to operate based on the lower pass if the first and second conditions are present.

19. The earthmoving machine of claim 1, wherein directing the earthmoving machine to operate on the lower pass includes setting a cut location for the work implement based on the lower pass.

20. The earthmoving machine of claim 19, wherein the earthmoving machine is operating in an autonomous mode.

* * * * *